US005603237A

United States Patent [19]

Bohman et al.

[11] Patent Number: 5,603,237

[45] Date of Patent: Feb. 18, 1997

[54] INCHING DRIVE SYSTEM FOR A MECHANICAL PUNCH PRESS

[75] Inventors: Kurt A. Bohman; W. Craig Brewer, both of Minster, Ohio

[73] Assignee: The Minster Machine Company, Minster, Ohio

[21] Appl. No.: 424,796

[22] Filed: Apr. 19, 1995

[51] Int. Cl.[6] ..... B21J 7/32; B21J 9/18

[52] U.S. Cl. ..... 72/444; 72/449; 100/257

[58] Field of Search ..... 72/444, 446, 449, 72/452.5, 452.7, 452.6; 100/257

[56] References Cited

U.S. PATENT DOCUMENTS

| | | | |
|---|---|---|---|
| 2,755,687 | 7/1956 | Danly . | |
| 3,687,069 | 8/1972 | Helrigel | 72/446 |
| 3,720,296 | 3/1973 | Ohno . | |
| 3,797,623 | 3/1974 | Gregorovich et al. . | |
| 3,841,140 | 10/1974 | Hryc . | |
| 3,859,863 | 1/1975 | Howlett . | |
| 4,039,060 | 8/1977 | Williams . | |
| 4,790,174 | 12/1988 | Wendland . | |
| 5,199,290 | 4/1993 | Kashiwagi . | |

FOREIGN PATENT DOCUMENTS

| | | | |
|---|---|---|---|
| 1299906 | 9/1961 | France . | |
| 3400817 | 7/1985 | Germany | 100/257 |

OTHER PUBLICATIONS

Eary and Reed, "Techniques of Pressworking", second edition, pp. 238 and 239 1974.

*Primary Examiner*—David Jones
*Attorney, Agent, or Firm*—Randall J. Knuth

[57] ABSTRACT

An inching drive system for a mechanical press including a hydraulic motor and gear mechanism, that engages the flywheel of the press. The hydraulic motor is mounted for rectilinear movement toward and away from the flywheel for selective engagement therewith and includes a gear that meshes with teeth on the periphery of the flywheel. A separate hydraulic piston/cylinder arrangement moves the inching drive system into and out of engagement with the flywheel.

9 Claims, 3 Drawing Sheets

INCHING DRIVE SYSTEM FOR A MECHANICAL PUNCH PRESS

BACKGROUND OF THE INVENTION

The present invention relates to a mechanical press and, more particularly, to a motor driven barring or inching system for incrementally driving the slide toward or away from the bed during tooling setup.

The typical mechanical press comprises a frame having a crown and bed mounted at opposite ends and a slide supported within the frame for motion toward and away from the bed. The bed is mounted to a platform on the floor of the shop. The crown portion is mounted within one or more uprights to create a vertically spaced separation between the crown and bed. The crown contains the drive assembly for the slide, which generally comprises a crankshaft having a plurality of eccentrics thereon and connecting rods connected to the eccentrics of the crankshaft at their upper ends and to the slide at their lower ends. The slide is mounted within the uprights for vertical reciprocating motion and is adapted to have the upper half of the die set mounted to it with the other half mounted to the bolster, which is connected to the bed.

A flywheel and clutch assembly are usually mounted at one end of the crankshaft. The flywheel is connected by a belt to the output pulley of a main drive motor so that when the motor is energized, the massive flywheel continuously rotates. When the clutch is energized, the rotary motion of the flywheel is transmitted to the crankshaft which causes the connecting rods to undergo rotary-oscillatory motion. This motion is transmitted to the slide assembly by means of a wrist pin, for example, so that the rotary-oscillatory motion is converted to straight reciprocating motion. The connecting rods are connected directly to the slide or connected by means of pistons which in turn are slidably received within cylinders connected to the crown.

During tooling setup, it is desirable to set the slide to a particular stroke position. The prior art includes at least two methods for accomplishing this task. The first method is to insert a lever, such as a long metal bar, into bores within the flywheel and lift or pull down the bar, to manually rotate the flywheel thereby causing the slide to move up or down. This method is awkward and inefficient. Two operators are required to set the slide to the desired stroke position. One operator is required to lift the bar and turn the flywheel while the other operator watches and informs the first operator when the slide reaches the desired stroke position. The view of the motion of the slide for the first operator is limited, making it difficult for the operator to determine the position of the slide.

A second method for adjusting the slide to a particular stroke position is to intermittently engage the clutch, while the flywheel is spinning, thereby incrementally moving the slide along until it reaches the desired stroke position. This method is problematic because of the difficulty in moving the slide by small increments and because the frequent engagement and disengagement of the clutch causes the associated clutch and brake pads to overheat, wear excessively, and warp.

SUMMARY OF THE INVENTION

The present invention overcomes the problems and disadvantages of the above-described prior art mechanical press barring systems by providing a separate high reduction motor to selectively engage the periphery of a rotatable drive train member, such as the flywheel, thereby causing the slide to move either up or down in small increments in a controlled fashion.

Generally, the present invention provides a mechanical press with an inching drive system for driving the slide slowly during tooling setup. The inching drive system comprises two primary devices. The first device is a separate drive motor assembly that selectively drives a rotating member, such as the flywheel, at a slow rate of speed thereby causing the slide to inch slowly toward a desired stroke position. The second device of the inching drive system comprises an engagement mechanism that causes the drive motor assembly to selectively engage the rotating member.

More specifically, the present invention provides, in one form thereof, a mechanical press having a flywheel with gear teeth. The flywheel is engaged and driven at a low rate of speed by a drive motor assembly comprising a hydraulic motor with a gear that engages the flywheel. The drive motor assembly is attached to an engagement mechanism which allows the drive motor assembly and gear to selectively engage or disengage the flywheel. The engagement mechanism comprises a sliding block on which the drive motor assembly mounts. A slider mount encloses and permits the sliding block to move only in a forward and reverse horizontal direction on the slider mount. A hydraulic cylinder is utilized to produce the force that causes the sliding block to slide on the slider mount. Through the use of appropriate hydraulic pressure or fluid controls, an operator causes the hydraulic cylinder to slide the drive motor and gear on the slider mount and into engagement or disengagement with the flywheel. The operator can then, through appropriate controls, cause the drive motor assembly and gear to rotate at a low rate of speed which in turn slowly rotates the flywheel and causes the slide to inch toward the desired stroke position.

An advantage of the inching drive assembly of the present invention is increased efficiency and decreased labor costs associated with press operation because only a single operator is required to set the slide to the proper stroke position. A single operator may inch the slide into a stroke position while directly monitoring the slide position. Also, the slide can be moved into position quicker and more accurately because the operator has improved control over slide movement.

Another advantage of the inching drive assembly of the present invention is that during tooling setup, the operator can directly monitor the motion and placement of the slide to ensure that nothing gets into the path of the moving slide.

A further advantage of the inching drive system is that it does not create additional stress on the clutch plates of the press. Because the clutch is not intermittently engaged during slide movement, the clutch plates are not stressed. The inching drive system reduces heat, warping, fatigue, and wear related clutch problems.

The invention, in one form thereof, provides a mechanical press of the type having a bed, slide and drive means that converts rotary-oscillatory motion to a linear reciprocating motion of the slide along a defined operating path toward and away from the bed. The drive means includes a rotating member and a drive motor assembly selectively engaging the rotating member for causing incremental rotation of the rotating member. An engagement mechanism is connected to the drive motor assembly causing selective engagement and disengagement of the drive motor assembly with the rotating member.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
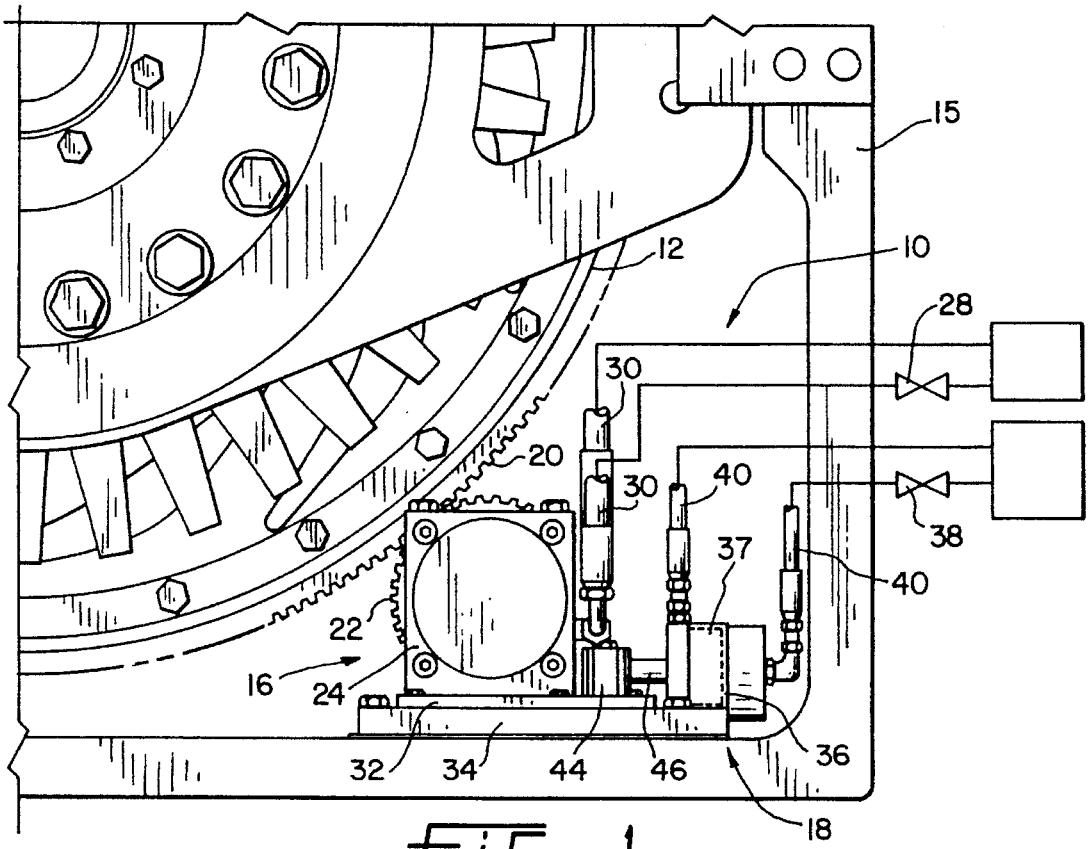
FIG. 1 is an elevational view of the invention in one form thereof with the inching drive system engaging the flywheel.
Figure 2:
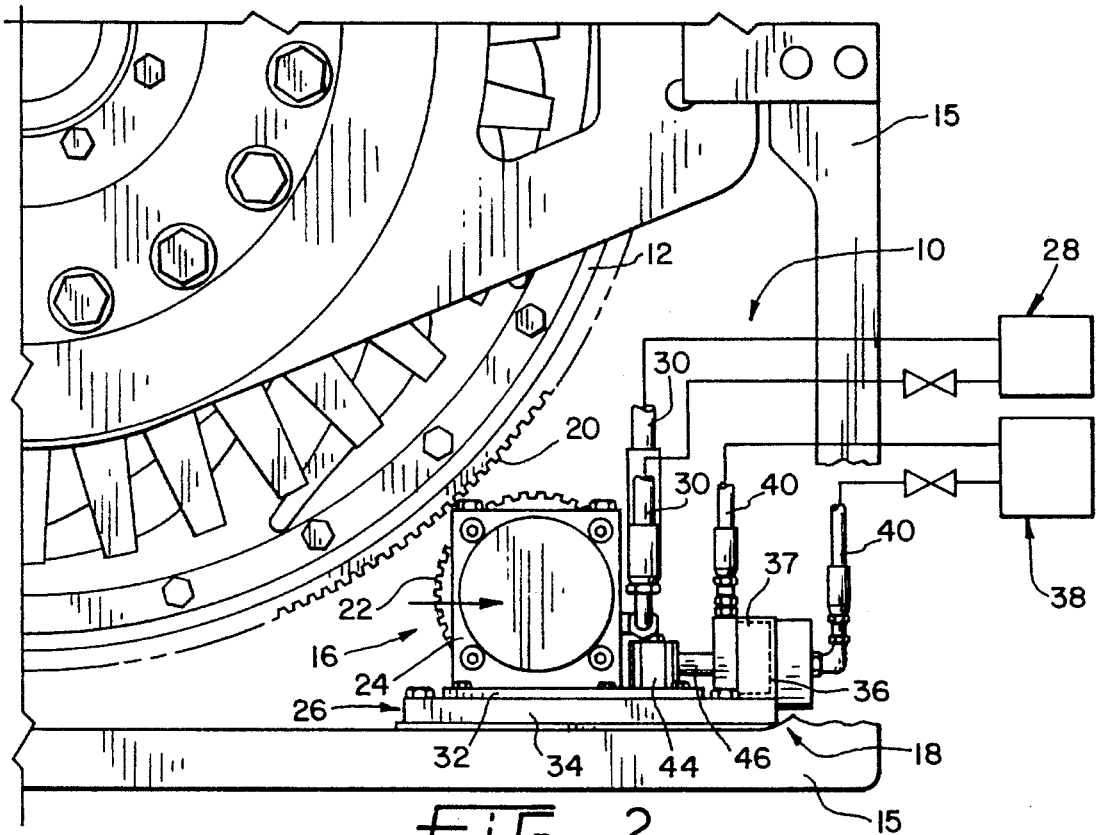
FIG. 2 is an elevational view of the invention with the inching drive system disengaged from the flywheel.
Figure 3:
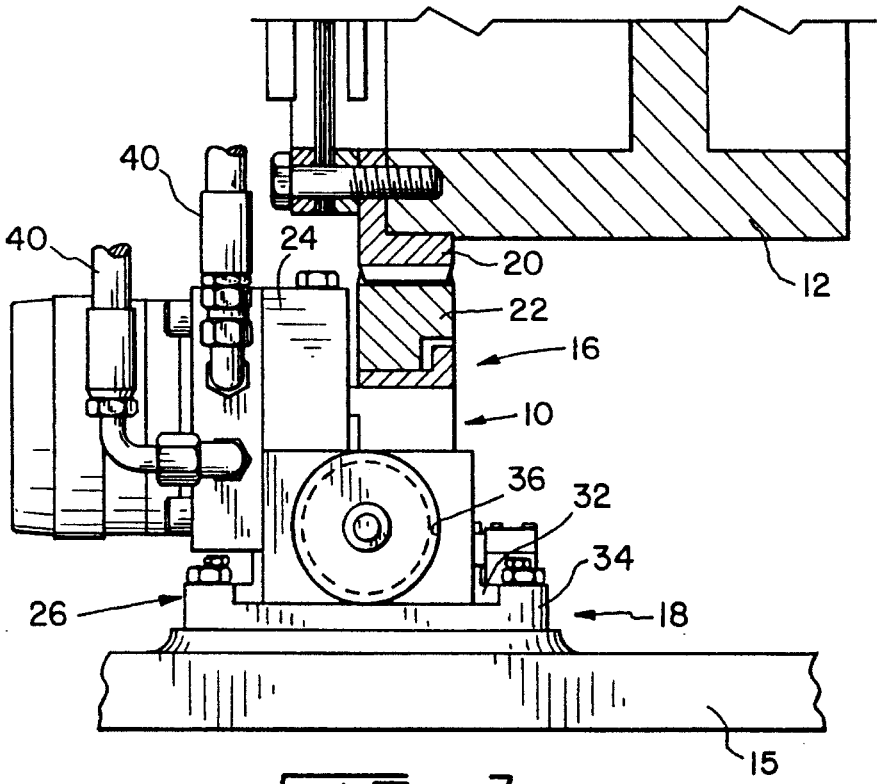
FIG. 3 is a side elevational view of the invention with the inching drive system engaging the flywheel.
Figure 4:
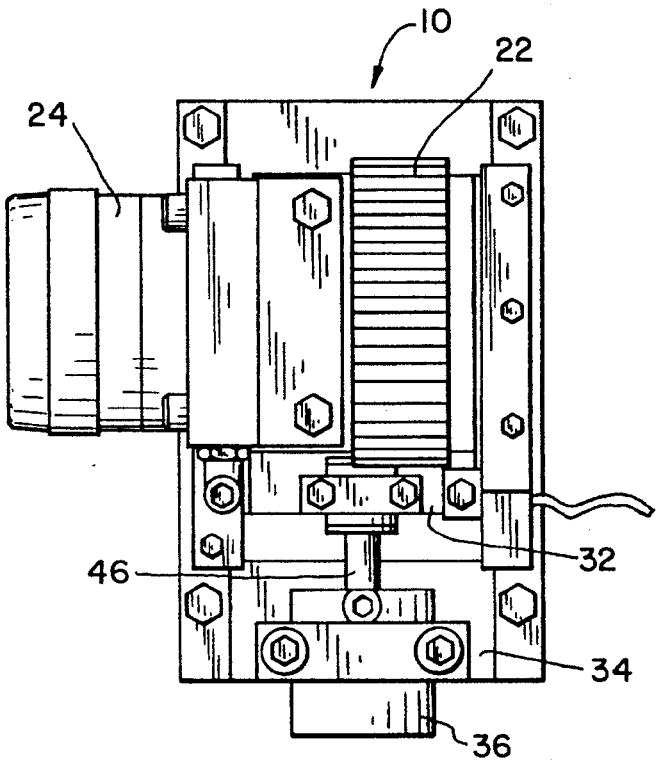
FIG. 4 is a top view of the inching drive system.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Figure 5:
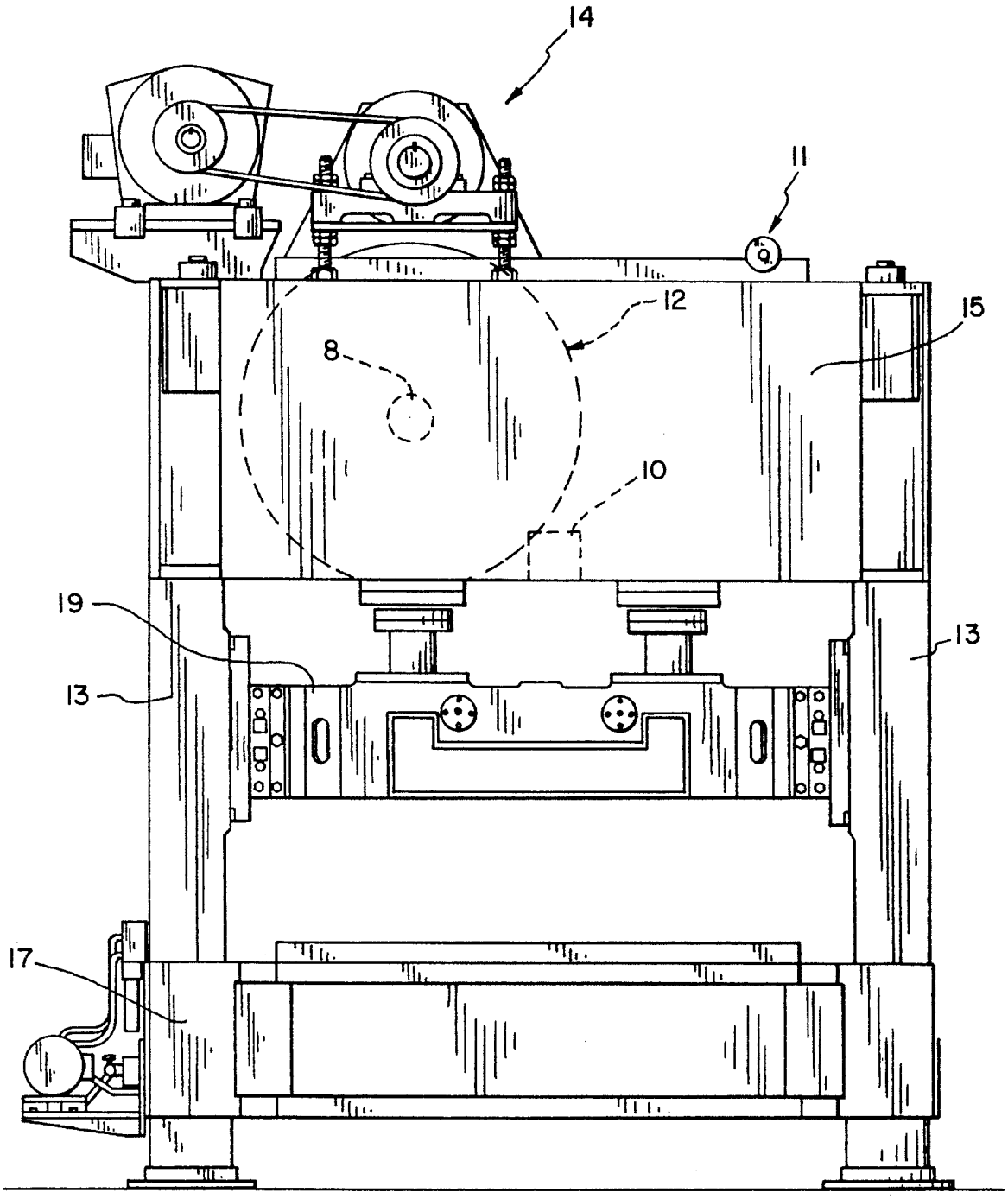
FIG. 5 is a front elevational view of a mechanical press incorporating the invention.

Inching drive system 10 of the present invention is incorporated into mechanical press 11 (FIG. 5) which, with the exception of inching drive system 10, is conventional in design and construction. In a preferred embodiment, mechanical press 11 consists primarily of frame 13 with crown 15 and bed 17 at opposite ends. Slide 19 is supported within frame 13 and reciprocates toward and away from bed 17. Crown 13 contains or supports the drive assembly 14 for slide 19 which includes flywheel 12, a clutch assembly and crankshaft 8. Crown 13 also includes conventional devices, such as connecting rods (not shown), for converting the rotary-oscillatory motion of the rotating members into a straight reciprocating motion of slide 19, as is known in the art.

Referring to FIG. 1, inching drive system 10 consists of two primary mechanisms: drive motor assembly 16 and engagement mechanism 18. Drive motor assembly 16, which mounts to engagement mechanism 18, selectively engages and rotates a rotatable member such as flywheel 12. In a preferred embodiment, flywheel 12 is the rotational member that is rotated by drive system 10. Gear teeth 20 are disposed about the very large circumference of flywheel 12 to facilitate engagement and rotation by inching drive system 10. Engagement mechanism 18 controls the selective engagement of drive motor assembly 16 with flywheel 12 for inching slide 19 into position for tool setup operations. During tooling setup, flywheel 12 is rotated by inching drive system 10 at a low speed causing slide 19 to inch toward a desired stroke position.

In a preferred form, drive motor assembly 16 comprises hydraulic motor 24 with hydraulic fluid ports 30 to allow hydraulic fluid to flow into and out of hydraulic motor 24. Hydraulic motor 24 may be of conventional design, such as a Model RE-18-07-04 hydraulic motor available from White Hydraulics Inc. A gear 22 is connected to and caused to rotate by hydraulic motor 24. A drive control means 28 is fluidly connected to hydraulic fluid ports 30 to control the flow of hydraulic fluid through hydraulic fluid ports 30 into hydraulic motor 24. Such drive control may be accomplished by manual or computer controlled valves, solenoids, or manifolds that are able to control hydraulic fluid flow. In a preferred embodiment, drive control means 28 may comprise a three position solenoid valve to control forward, reverse, and stop/brake operations of hydraulic motor 24. Hydraulic motor 24 and gear 22 rotate in a forward or reverse direction by the introduction of hydraulic fluid into hydraulic motor 24.

During tooling setup operations, gear 22 engages gear teeth 20 of flywheel 12. A slow rotation of gear 22, while engaged to gear teeth 20, causes flywheel 12 to slowly rotate, which in turns causes slide 19 to slowly move into position for tooling setup. Because the circumference of flywheel 12 is much larger than the circumference of gear 22, inching drive 16 is capable of rotating flywheel 12 very slowly and at relatively high torque. By way of example, flywheel 12 may have a circumference of 40 inches and 249 teeth on gear 20 whereas gear 22 may have a circumference of 6 inches and have 36 teeth thereon.

Selective engagement of flywheel 12 by gear 22 is controlled by engagement mechanism 18. Engagement mechanism 18 allows drive motor assembly 16 to move or slide rectilinearly toward or away from flywheel 12 to respectively engage or disengage.

Engagement mechanism 18 comprises a slider mount assembly 26 having sliding block 32 and slider mount 34. Slider mount 34 has sides that extend vertically upward and inward to secure and confine the horizontally extending sides of sliding block 32 and to prevent vertical or rotational movement of sliding block 32 but permit forward and reverse rectilinear sliding movement. A hydraulic cylinder 36 is mounted on slider mount 34 having an internally disposed piston and externally mounted fluid ports 40. An engagement control means 38 is fluidly connected to hydraulic cylinder 36 through fluid ports 40, while a push rod 46, having ends 45 and 47 is connected to the piston and slider mount 34, respectively.

Engagement control 38 controls the introduction of hydraulic fluid into hydraulic cylinder 36 through fluid ports 40. In one embodiment, engagement control device 38 may comprise a two position solenoid valve. Other alternative mechanisms for controlling hydraulic fluid supplied to hydraulic cylinder 36 may include manual or computer controlled valves, pumps, manifolds, or other mechanisms for controlling and supplying hydraulic fluid.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A mechanical press of the type having a bed, a slide, and drive means that converts rotary-oscillatory motion to a linear reciprocating motion of said slide along a defined operating path toward and away from said bed, said drive means having a rotating member, the press comprising:

a drive motor assembly selectively engaging said rotating member for causing incremental rotation of said rotating member; and an engagement mechanism including: a slider mount assembly slidably securing said drive motor assembly to said press;

an engagement cylinder connected to said slider mount assembly to cause said drive motor assembly to slide in a forward and reverse direction; and engagement control means controlling said engagement cylinder to cause said sliding motion, said engagement mechanism connected to said drive motor assembly causing said selective engagement of said drive motor assembly with said rotating member.

2. The press according to claim 1 wherein said rotating member comprises a flywheel having gear teeth disposed about its circumference, and said drive motor assembly includes a driven gear that is in engagement with the gear teeth of said flywheel, said driven gear having a much smaller circumference than the circumference of said flywheel.

3. The press according to claim 1 wherein said drive motor assembly comprises:

a gear having a plurality of teeth for engaging said rotating member;

a drive motor connected to said gear to cause said gear to slowly rotate; and drive control means controlling said drive motor to cause said drive motor to rotate said gear.

4. The press according to claim 3 wherein said drive motor is a hydraulic drive motor capable of slowly rotating said gear, rotation of said drive motor influenced by flow of hydraulic fluid within said hydraulic drive motor.

5. A method of operating a mechanical press during tooling setup, wherein the press includes a slide and a large circumference flywheel, said method comprising:

engaging the outer periphery of the flywheel with a rotatable member moved along a slider mount assembly by an engagement cylinder, and slowly rotating the rotatable member to thereby slowly rotate the flywheel to move the slide through small increments.

6. The method of claim 5 wherein the periphery of the flywheel is toothed and the rotatable member is a gear, and the step of engaging comprises moving the gear into meshing engagement with the flywheel.

7. The method of claim 6 wherein the step of rotating the rotatable member includes driving the member by means of a hydraulic motor.

8. A mechanical press comprising:

a bed;

a slide;

drive mechanism that converts rotary-oscillatory motion to a linear reciprocating motion of said slide along a defined operating path toward and away from said bed, the drive mechanism comprising a flywheel with teeth on its periphery;

a drive motor assembly including a gear selectively engaging said flywheel teeth for causing slow rotation of said flywheel and incremental movement of said slide; and an engagement mechanism connected to said hydraulic drive motor assembly causing said selective engagement of said gear with said flywheel, said engagement mechanism including:

a slider mount assembly securing said drive motor assembly to said press;

an engagement cylinder connected to said slider mount assembly to cause said drive motor assembly to slide in a forward and reverse direction; and engagement control means controlling said engagement cylinder to cause said sliding motion.

9. The press of claim 8 wherein said drive motor is a hydraulic motor.

* * * * *